US006308865B1

(12) United States Patent
Lin

(10) Patent No.: US 6,308,865 B1
(45) Date of Patent: Oct. 30, 2001

(54) CONTAINER-MOUNTED PUMP MEANS WITH EXTERNAL RESTORING SPRING

(76) Inventor: Hui-Yu Lin, 2nd Floor, No. 3, Cheng-Teh Road, Sec. 4, Taipei (111) (TW)

( * ) Notice: Subject to any disclaimer, the term of this patent is extended or adjusted under 35 U.S.C. 154(b) by 0 days.

(21) Appl. No.: 09/697,280

(22) Filed: Oct. 24, 2000

(51) Int. Cl.[7] ..... B67B 5/00

(52) U.S. Cl. ..... 222/153.13; 222/321.9; 222/380; 222/340; 222/384

(58) Field of Search ..... 222/153.03, 384, 222/340, 385, 321.9, 321.1, 380, 153.13

(56) References Cited

U.S. PATENT DOCUMENTS

| | | | | |
|---|---|---|---|---|
| 2,956,509 | * | 10/1960 | Cooprider et al. | 103/178 |
| 3,759,426 | * | 9/1973 | Kane | 222/385 |
| 4,183,449 | * | 1/1980 | Blake | 222/321 |
| 4,243,159 | * | 1/1981 | Spatz | 222/188 |
| 4,369,900 | * | 1/1983 | Saito et al. | 222/321 |
| 4,458,832 | * | 7/1984 | Corsette | 222/153 |
| 4,503,997 | * | 3/1985 | Corsette | 222/321 |
| 5,307,962 | * | 5/1994 | Lin | 222/321 |
| 5,409,146 | * | 4/1995 | Hazard et al. | 222/321.8 |
| 5,664,706 | * | 9/1997 | Cater | 222/321.2 |
| 6,010,036 | * | 1/2000 | Bougamont et al. | 222/183 |
| 6,065,647 | * | 5/2000 | Bliss | 222/153.02 |

* cited by examiner

*Primary Examiner*—Kevin Shaver
*Assistant Examiner*—F. Nicolas

(57) ABSTRACT

A pump device adapted to be mounted on a liquid container includes a nozzle head formed on a top portion of a piston reciprocatively held in a liquid accumulator mounted on the liquid container, a restoring spring resiliently retained between the nozzle head and a fastening ring which is secured on an upper portion of the accumulator, a container cap secured on a top portion of the liquid container and fastened between the fastening ring and a flange of the accumulator, a suction tube connected to the accumulator and inserted in the liquid container for sucking liquid into the accumulator; characterized in that the restoring spring is disposed around a piston rod outside an interior of the pump and of the accumulator to prevent contamination of the liquid by the spring or to prevent corrosion of the spring by the liquid.

1 Claim, 3 Drawing Sheets

CONTAINER-MOUNTED PUMP MEANS WITH EXTERNAL RESTORING SPRING

BACKGROUND OF THE INVENTION

U.S. Pat. No. 5,307,962 issued to the same inventor of this application disclosed a container mounted pump with an improved check valve formed thereon. However, the spring (3), provided for urging the piston (2) upwardly when releasing the nozzle head (1) to suck liquid into the accumulator (4) for pumping liquid outwardly, is formed in the accumulator (4) to be impregnate ed in the liquid to possibly contaminate the liquid by the spring. The spring (3), if being made of steel or iron material, may be Corroded or eroded by the liquid (aqueous solution) within the accumulator.

The present inventor has found the drawbacks of the conventional a container-mounted pump and invented the present pump means having external restoring spring provided outside the accumulate or.

SUMMARY OF THE INVENTION

The object of the present invention is to provide a pump device adapted to be mounted on a liquid container including a nozzle head formed on a top portion of a piston reciprocatively held in a liquid accumulator mounted on the liquid container, a restoring spring resiliently retained d between the nozzle e head and a fastening ring which is secured on an upper portion of the accumulator, a container cap secured on a top portion of the liquid container and fastened between the fastening ring and a flange of the accumulator, a suction tube connected to the accumulator and inserted in the liquid container for sucking liquid into the accumulator; characterized in that the restoring spring is disposed around a piston rod outside an interior of the pump and of the accumulator to prevent contamination of the liquid by the spring or to prevent corrosion of the spring by the liquid.

DETAILED DESCRIPTION

Figure 1:
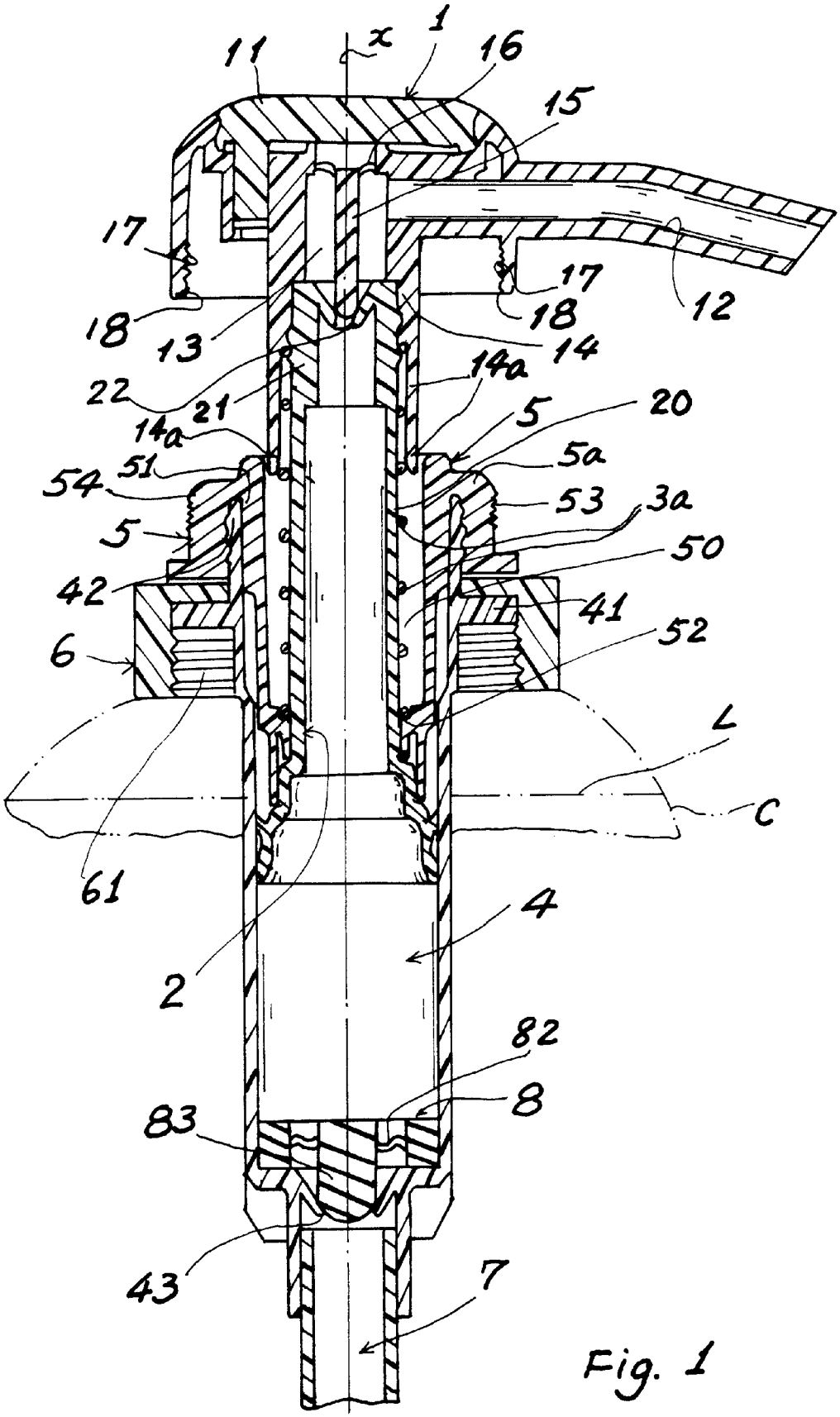
FIG. 1 is a sectional drawing of the present invention.
Figure 2:
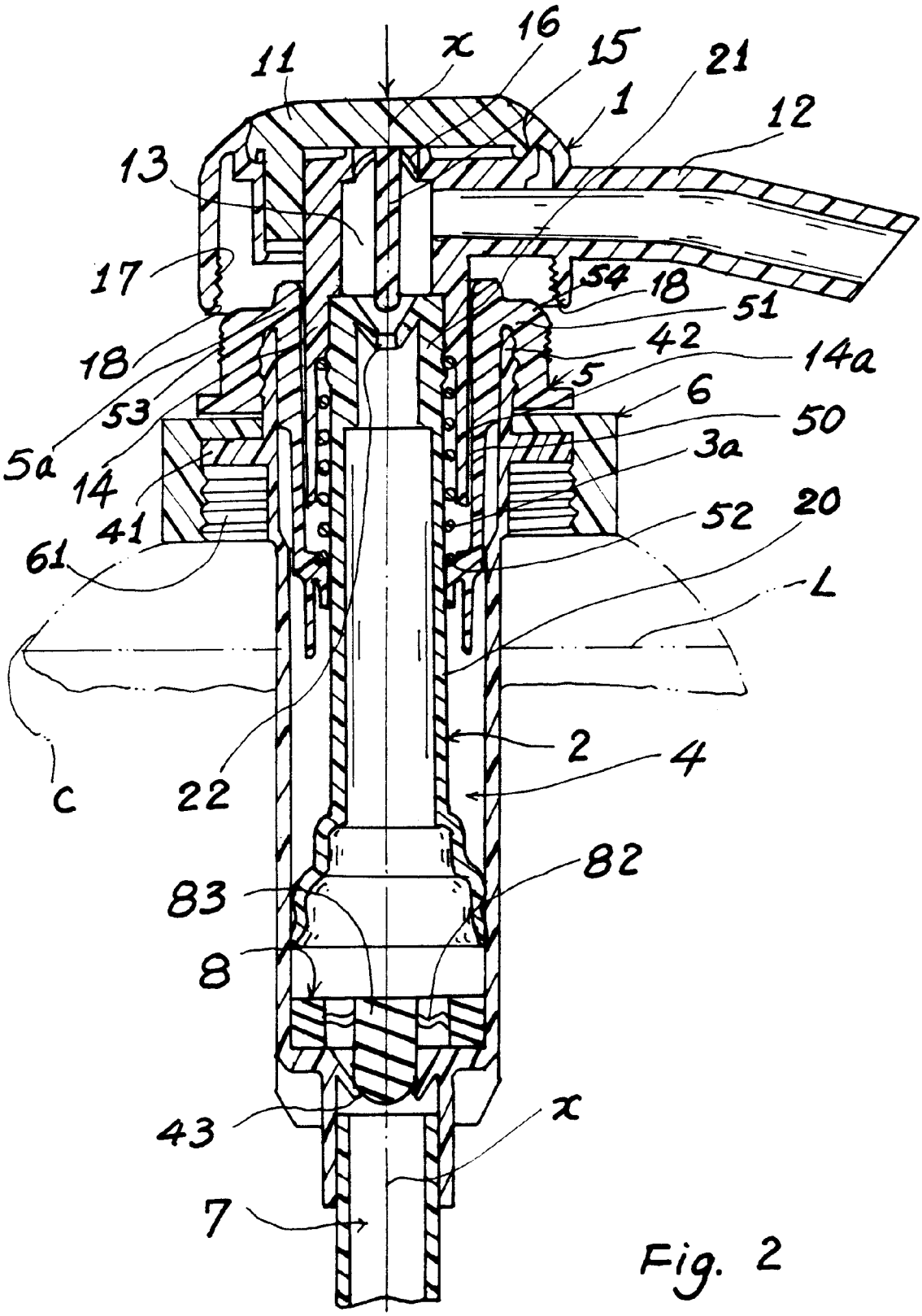
FIG. 2 is a sectional illustration of the present invention when depressing the nozzle head downwardly.
Figure 3:
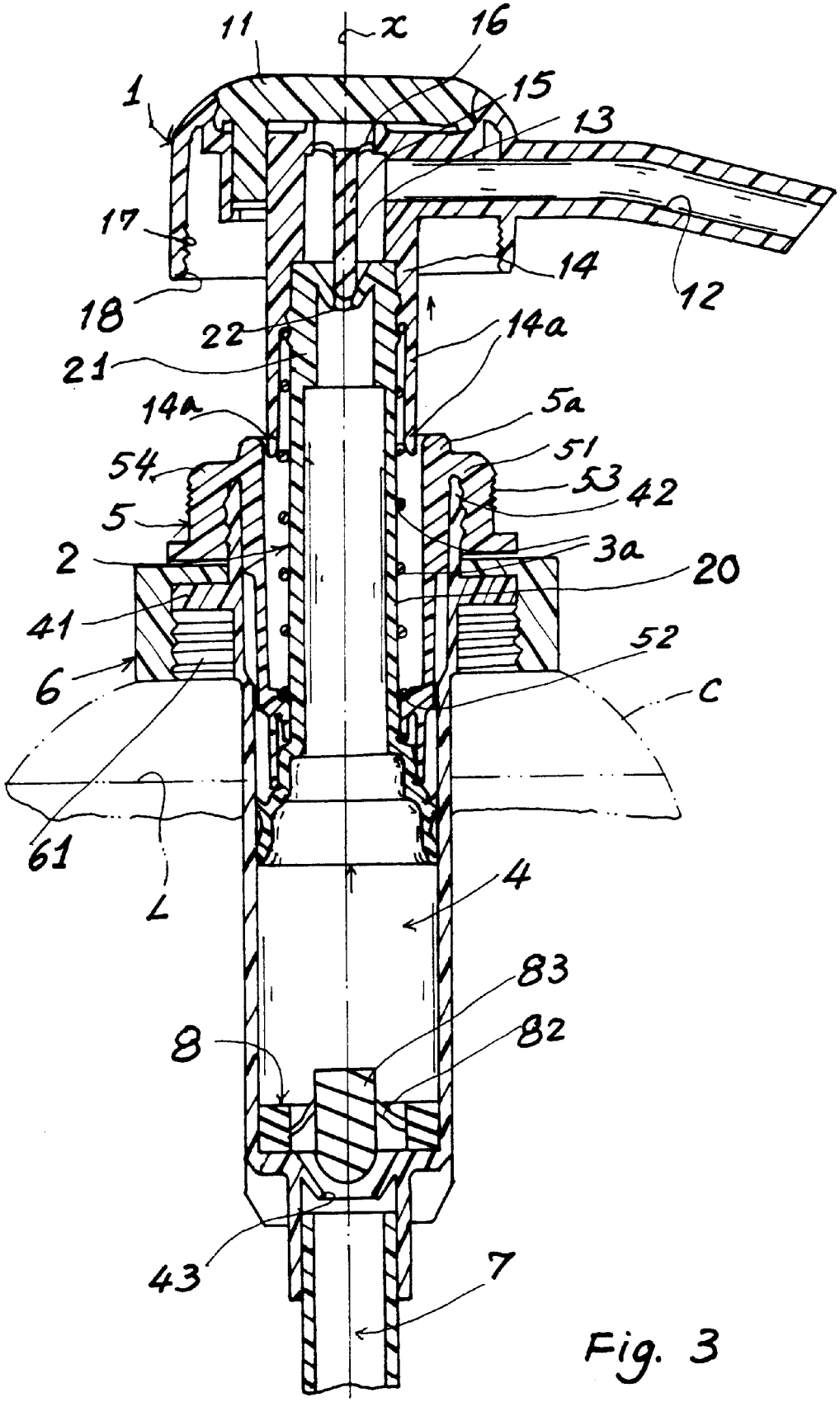
FIG. 3 is a sectional illustration showing an upward movement of the piston as restored by the spring for suction of liquid into the accumulator.

As shown in FIGS. 1~3, the pump means adapted to be mounted in a liquid container C for storing liquid L including detergent, shampoo, cream or other liquids into the container C comprises: a nozzle head 1, a piston 2 secured with the nozzle head 1, a restoring spring 3*a* normally restoring the piston 2 upwardly, a liquid accumulator 4 secured on a top portion of the liquid container C, a fastening ring 5 secured on a top portion of the accumulator 4, a container cap 6 secured on a top portion of the liquid container C and fastened in between the fastening Ting 5 and the accumulator 4, a lower plunger valve 83 and an upper plunger valve 15 respectively formed in a lower portion and an upper portion of the pump means of the present invention, and a suction tube 7 connected to the accumulator 4 and inserted into the liquid container C.

The nozzle head 1 includes: a pressing cap 11 formed on a top portion of the nozzle head 1, a discharge tube 12 protruding outwardly from the pressing cap 11 and fluidically communicated with a pipe 13 longitudinally formed in a central portion of the nozzle head 1, a fastening member 14 formed on a lower portion of the pipe 13, an upper sleeve portion 14*a* protruding downwardly from the fastening member 14 for holding an upper spring portion of the restoring spring 3*a*, and an upper plunger valve 15 resiliently secured to an upper portion of the pipe 13 by an elastic member 16.

The piston 2 is reciprocatively held in an interior in the accumulator 4 and includes: a hollow piston rod 20 having a fastening portion 21 formed on an upper portion of the piston rod 20 to be engaged with the fastening member 14 of the nozzle head 1, and an upper valve opening 22 formed in an upper portion of the fastening portion 21 to be normally closed by the upper plunger valve 15 of the nozzle head 1.

The accumulator 4 includes: a flange 41 circumferentially formed on an upper portion of the accumulator 4 to be engaged with the container cap 6, a lower valve opening 43 formed in a lower portion of the accumulator 4 to be communicated with the suction tube 7, a coupling portion 42 formed on a top portion of the accumulator 4 to be coupled with a coupling member 51 of the fastening ring 5 to fasten the container cap 6 in between the fastening ring 5 and the flange 41 of the accumulator 4; whereby upon securing of the container cap 6 on a top portion of the liquid container C by engaging inner threads 61 formed in the cap with male threads formed on the container C, and by inserting the suction tube 7 connected with the accumulator 4 into the container C, the liquid L will be sucked into the interior of the accumulator and then discharged outwardly through the discharge tube 12 when operating the pressing cap 11 and the piston 2.

The fastening ring 5 includes: a lower sleeve portion 5*a* having a coupling member 51 formed on an upper portion of the lower sleeve portion 5*a* to be engaged with the coupling portion 42 of the accumulator 4, an annular groove 52 annularly formed in a lower portion of the lower sleeve portion 5*a* for retaining a lower spring portion of the restoring spring 3*a*, and a cylindrical chamber 50 concentrically defined between the piston rod 20 and the lower sleeve portion 5*a* for receiving the restoring spring 3*a* and the upper sleeve portion 14*a* of the nozzle head 1 when downwardly depressing the pressing cap 11 for pumping liquid as shown in FIG. 2.

The lower plunger valve 83 includes a valve disk 8 made of elastomer materials including plastic and rubber materials secured in a lower portion of the accumulator 4, and an elastic member 82 for connecting the plunger valve 83 to the valve disk 8, with the lower plunger valve 83 resiliently restored downwardly to close the lower valve opening 43 for well closing the valve opening 43 normally.

When using the present invention for outwardly pumping liquid L from the liquid container C, the pressing cap 11 of the nozzle head 1 is depressed downwardly to urge the piston 2 downwardly and the upper plunger valve 15 will be upwardly driven for opening the valve 15 as shown in FIG. 2 (from FIG. 1 to FIG. 2). The restoring spring 3*a* is also compressed to store its restoring energy.

Upon releasing of the pressing cap 11, the spring 3*a* will restore the nozzle head 1 and the pump 2 upwardly (from FIG. 2 to FIG. 3) to open the lower plunger valve 83 to suck liquid L from the container C into the interior of the accumulator 4 and the upper plunger valve 15 will also be closed. When the piston 2 is upwardly restored without producing further suction force on the liquid, the resilience of the lower plunger valve 83 will restore itself to close the opening 43 of the valve 83 (from FIG. 3 to FIG. 1). Further depressing on the cap 11, the liquid in the accumulator 4 will be pumped outwardly through the valve opening 22, pipe 13 and discharge tube 12 (FIG. 2) for its end use. Since the restoring spring 3*a* as disposed about the piston rod 20 is positioned outside the accumulator 4, the spring 3*a* will not contact the liquid L in the accumulator, thereby preventing contamination of the liquid by the spring 3*a*. Also, the spring 3*a* will not be corroded or eroded by the liquid.

Therefore, the present invention is an improvement of the prior art of U.S. Pat. No. 5,307,962.

The pressing cap 11 further includes a female-threaded portion 17 formed in a lower perimeter of the cap 11 and a tapered portion 18 formed on a lowermost rim of the pressing cap 11 as tapered downwardly from the female threaded portion 17. The lower sleeve portion 5*a* of the fastening ring 5 is formed with a male-threaded portion 53 on its upper portion to be engaged with the female-threaded portion 17 of the nozzle head 1 when coupling (not shown) the nozzle head 1 with the fastening ring 5 by rotating the pressing cap 11 about a longitudinal axis X at a longitudinal center of the pump means of the present invention. A lower tapered portion 54 is formed on the upper portion of the lower sleeve portion 5*a* as tapered upwardly from the male threaded portion 53 to be tangential to the tapered portion 18 of the nozzle head 1. The tapered portion 18 and the lower tapered portion 54 will help guide the coupling of the nozzle head 1 with the fastening ring 5 when engaging the female-threaded portion 17 with the male-threaded portion 53.

The present invention may be further modified without departing from the spirit and scope of the present invention.

I claim:

1. A pump means adapted to be mounted on a liquid container comprising:

a nozzle head including a pressing cap formed on a top portion of a pipe, a discharge tube protruding outwardly from said pressing cap and fluidically communicated with said pipe, an upper plunger valve formed in said pipe, and a fastening member formed on a lower portion of said pipe;

a piston including a hollow piston rod and a fastening portion formed on a top portion of said piston rod to be engaged with said fastening member of said nozzle head for securing said nozzle head with said piston;

a liquid accumulator mounted in an upper portion of said liquid container, having said piston operatively reciprocating in said accumulator;

a fastening ring secured on an upper portion of said accumulator;

a container cap secured on a top portion of said liquid container and fastened between the fastening ring and a flange formed on an upper portion of the accumulator;

a restoring spring normally restoring said nozzle head and said piston upwardly;

a suction tube connected to said accumulator; and a lower plunger valve formed in a lower portion of said accumulator;

the improvement which comprises:

said restoring spring resiliently held between an upper sleeve portion protruding downwardly from said fastening member of said nozzle head and an annular groove annularly recessed in a lower sleeve portion of said fastening ring; said restoring spring disposed about said piston rod and positioned outside said piston and said accumulator without contacting a liquid as pumped through said accumulator; and said fastening ring having a cylindrical chamber concentrically defined between said lower sleeve portion of said fastening ring and said piston rod for receiving said restoring spring and said upper sleeve portion of said nozzle head into said cylindrical chamber when downwardly depressing said pressing cap of said nozzle head for compressing said spring.

* * * * *